United States Patent [19]

Teplinsky et al.

[11] 4,186,793

[45] Feb. 5, 1980

[54] AUTOMATIC LINE FOR COATED METAL MOULD CASTING

[76] Inventors: Anatoly D. Teplinsky, ulitsa Generala Petrova, 27, korpus 1, kv. 73; Grigory A. Yarovinsky, Treugolny pereulok, 13, kv. 14; Rostislav L. Snezhnoi, ulitsa Bogdana Khmelnitskogo, 36, kv. 12; Savely L. Burakov, Treugolny pereulok, 13, kv. 23; Vladimir S. Serebro, ulitsa Ostrovidova, 88, kv. 1; Yakov M. Ryvkis, ulitsa Garibaldi, 14, kv. 26; Lidia P. Kolienko, ulitsa Tereshkova, 2, korpus 5, kv. 28, all of Odessa; Anatoly I. Bolshakov, ulitsa 25 let Oktyabrya, 92, kv. 52; Vladimir A. Antonov, ulitsa Fitko, 14, kv. 63, both of Tiraspol Moldavskoi SSR; Gerbert G. Tsaizer, prospekt Lenina, 22, kv. 12, Chelyabinsk; Moisei S. Shapiro, pereulok Artilleristov, 2, kv. 8, Chelyabinsk; Mark M. Pekarsky, ulitsa 40 let Oktyabrya, 28, kv. 123, Chelyabinsk, all of U.S.S.R.

[21] Appl. No.: 887,532

[22] Filed: Mar. 17, 1978

[51] Int. Cl.[2] ..... B22D 47/00

[52] U.S. Cl. ..... 164/158; 164/168; 164/324

[58] Field of Search ..... 164/158, 167, 168, 267, 164/324

[56] References Cited

U.S. PATENT DOCUMENTS

| | | | |
|---|---|---|---|
| 1,752,308 | 4/1930 | Pettis | 164/158 X |
| 2,999,281 | 9/1961 | Drever et al. | 164/168 X |

OTHER PUBLICATIONS

Foundry Trade Journal, vol. 133, No. 2900, Jul. 6, 1972, pp. 3–12, "Automatic Moulding Techniques Employed at the George Fisher Herblingertal Foundry", O. Hikl.

*Primary Examiner*—Robert D. Baldwin

*Attorney, Agent, or Firm*—Lackenbach, Lilling & Siegel

[57] ABSTRACT

An automatic line comprises, arranged in series in accordance with the casting flowsheet and interconnected by conveyer means: a unit for applying a coating to the working face of the metal mould parts; a unit for assembling metal moulds from the coated parts thereof; a unit for pouring molten metal into the assembled mould; a unit for solidifying the casting inside the mould; a unit for disassembling the mould and removing the casting therefrom; a unit for cleaning the mould parts off the used coating; a unit for stabilizing the temperature of the cleaned mould parts prior to a re-coating cycle. Arranged along a section of the conveyer means intermediate the mould assembly unit and the pouring unit is a heater with the length thereof being equal to that of the conveyer, and arranged along the section of the conveyer means intermediate the pouring unit and the mould disassembly unit is also a heater with the length thereof being equal to that of the conveyer, which heater becomes operable after the whole automatic line is shut down.

7 Claims, 4 Drawing Figures

AUTOMATIC LINE FOR COATED METAL MOULD CASTING

FIELD OF THE INVENTION

The present invention relates to foundry practice, and more particularly to automatic lines for casting into coated metal moulds. It is common knowledge that coated metal moulds are used for the production of high-quality castings, of just about any configuration and from various metals, including cast irons with flaked and globular graphite, as well as from carbon and alloy steels, etc. The produced castings vary in size and weight, ranging from tens of millimeters to one and more meters, and from hundreds of grams to 300 and more kilograms.

The coated metal moulds are advantageously used for manufacturing crankshafts or automobile and tractor engines, skeleton frames for electric motors, bodies of antifriction boxes used in railway cars, bodies of hydraulic system control valves with cast-in channels, driven sprockets for tractors and many other like parts.

DESCRIPTION OF THE PRIOR ART

For example, there is known in the art an automatic line for casting into coated metal moulds (cf. E. G. Nickolayenko, "Coated Metal Mould Casting", Foundry Practice magazine, 1969, No. 1). Such automatic line incorporates separate units arranged in series in accordance with the casting flowsheet. The units are interconnected with one another by means of conveyers in the form of roller tables which also function as inter-operation storages.

A unit for applying a coating to the working surfaces of a metal mould and its setting thereon includes a four-station rotary mould blower mounting disposed on two stations thereof and with diametrically opposed heated pattern plates of the metal mould upper parts, the lower parts thereof being arranged on two other stations. The unit also incorporates a manipulator for removing the uncoated metal mould parts from a roller table and transferring them to the station for coating. Diametrically opposed to the afore said manipulator is a manipulator for removing the metal mould coated parts from the rotary arrangement and placing them on the roller table with upwardly facing working surfaces. The coating is first applied to the upper part of the mould and then to the lower part thereof, the coated parts being placed on the roller table in the same sequence.

When the coated parts of the metal mould are moved along the roller table, the quality thereof is subjected to control effected by an operator and, if necessary, cores are set in said parts to be thereafter transferred to the mould assembly unit which incorporates an assembly mechanism and a system of supports.

In the assembly unit, the top part of a metal mould is lifted and engaged by stationary clamps, and on removing the lifting device, the mould is tilted with their working surface facing downwardly. The bottom part of the metal mould is lifted by the same device so as to be brought in contact with the bottom part. The mould upper part is released from the clamps and the assembled mould is lowered down on the roller table and thereby transferred to the molten metal pouring unit.

The pouring unit is made in the form of a roller table fitted with driven supports adapted to set the mould in a position enabling molten metal to be poured into said mould by any conventional means. Thereafter, the mould is transferred to a unit for the solidification of the metal cast in the mould.

The unit for the solidification of the metal cast in the mould is essentially a roller table with a length and a travel speed thereof such as to provide for a time period sufficient for the cast metal to solidify in the mould during the mould's travel along the roller table.

The mould with the cast metal, solidified and cooled down to a temperature allowing for the casting removal from the mould, is then conveyed to a unit for the mould disassembly and removal of the casting. The disassembly unit consists of the mould disassembly mechanism and a mechanism for removing the casting from the mould, and said mechanisms are arranged in space relation along the roller table. The disassembly mechanism is operated to effect lifting of the mould from the roller table, with the mould upper part engaged by stationary clamps. The casting is forced out by a special device to the mould lower part which is placed by means of the lifting device on the roller table to be transferred to the casting removal mechanism. As this happens, the mould upper part is turned over with its working surface facing up, the lifting device moves upwardly to come in contact with the mould upper part which is released from the clamps and lowered down by the same lift on the roller table to be transferred to a unit for cleaning the mould parts from the used coating.

The casting removal mechanism is operated to effect the lifting of the mould lower part with the casting from the roller table, which is then clamped and turned over with the working face facing down. With the aid of a special mechanism the casting is forced out into a receiver. The lower part of the mould is turned over in the reverse direction and is placed on the roller table when released from the clamps. Thereafter, the mould lower part is also transferred to a unit for cleaning the mould parts from the used coating.

The cleaning unit referred to above comprises a roller table mounting a chamber for blasting the working face of the mould parts with compressed air, and rotary scratch brushes. The cleaned parts of the mould are further conveyed to a unit for stabilizing the cleaned temperature of the mould parts prior to a new re-coating cycle, which unit consists of a sealed housing and nozzles for cooling the mould parts with an air-water mixture, mounted on a roller table.

Cooled to a predetermined temperature, the mould parts (the mould is heated by the molten metal poured thereinto) are transferred by means of the roller table to a device for turning over said parts with the working face facing down, and thence to a station where uncoated parts of the mould are placed on the rotary arrangement of the unit for applying a coating to the mould working faces and for its setting thereon.

The automatic coating unit is likewise provided with a furnace arranged on the outside of the casting process line and adapted for preheating the metal mould parts prior to putting them into operation. With the aid of the roller table the mould parts, preheated in the furnace, can be transferred to the roller table of the mould parts cleaning unit outside the process line.

Prior to bringing the above-described automatic casting unit into operation, the mould parts are heated piecewise, which operation is time-consuming and laborious; or else coating is applied to the surfaces of all parts of the mould before the automatic unit is shut down, the process being started with the pouring operation. This impairs the production efficiency both at the beginning and at the end of the casting process, insofar as it is necessary to carry out a definite number of pouring cycles (which depends upon the mould capacity) required for heating the mould coated parts to the working temperature with molten metal, gradually increasing the time period of holding castings in the mould and slowing down the coating operation due to a rapid and insufficient setting of the coating applied to the surfaces of the mould parts having low temperature. Where a small-size casting is desired, the amount of heat generated from the molten metal poured into the mould is insufficient to ensure heating of the mould parts. If the molten metal is fed at intervals or intermittently, as is often the case in steelmaking, the temperature parameters of the assembled moulds will be upset.

In the event the moulds, before pouring molten metal thereinto, have different temperatures, the working cavities thereof will likewise differ from one another in size just as castings will, as well as the cooling conditions thereof, which will result in different structure and mechanical characteristics of the castings. This, however, is inadequate since a number of parts such as camshafts for automobile engines which have incorporated therein cams and eccentrics, must possess strictly specified hardness characteristics considerably superior to those found in other parts of the casting.

SUMMARY OF THE INVENTION

It is therefore an object of the present invention to insure the production in coated moulds of high-quality castings strictly conforming to a specified geometrical configuration, and structure and having the desired physical-and-mechanical properties of the case metal.

Another object of the invention is to provide an automatic line for casting into coated metal moulds, which will make it possible to maintain a predetermined temperatures of the metal mould parts and those of the assembled mould throughout the casting process.

This and other objects are features of the invention are accomplished by the provision of an automatic line for casting into coated metal moulds, comprising, successively arranged in the direction of the casting process and interconnected by conveyer means: a unit for applying a coating to the working surfaces of the metal mould parts and its setting thereon; a unit adapted for carrying out the metal mould assembly from the coated parts thereof; a unit for pouring molten metal into the assembled mould; a unit for the solidification of the metal being cast in the mould; a unit for the mould disassembly and removal of the casting; a unit for cleaning the mould parts from the used coating; a unit for stabilizing the temperature of the cleaned mould parts prior to a re-coating cycle. In accordance with the invention, there is also arranged along the section of a conveyer means, intermediate the mould assembly unit, and the pouring unit a heater adapted to maintain a requisite temperature of the assembled moulds, and arranged in the way of a conveyer means, intermediate the pouring unit and the mould disassembly and casting removal unit, is another heater which becomes operative as the whole automatic unit is shut down or upon termination of metal supply, and the intermediate sections mounting said heaters are interconnected by means of an additional conveyer adapted to transfer the assembled mould from one section to another.

The automatic line of the invention for casting into coated metal moulds makes it possible:

to maintain predetermined temperatures of the metal mould parts and those of the assembled moulds throughout the casting process; to obtain high-quality castings with stable physical-and-mechanical properties, and to achieve a prescribed metal structure, strictly conforming in shape to the desired and requisite configurations;

to maintain predetermined temperatures of the assembled moulds, both coated and uncoated, during long idling periods in the operation of the automatic line;

to prevent whatever losses in efficiency or defects in the castings produced after the automatic line is put back into operation upon termination of a long idling period;

to effectively use an automatic line under operating conditions requiring intermittent pouring of molten metal into moulds, for example, in steelmaking; and to provide storage for the assembled moulds without increasing the length of the automatic line apparatus.

It is expedient that each heating device is made in the form of a furnace with a conveyer means of the corresponding operating section passing through its interior; the length of the furnace should correspond to that of the conveyer means passing therethrough.

In addition to the aforementioned advantages, the above structural arrangement makes it possible to bring under control noxious fumes and liberated heat, as well as to substantially improve the health conditions of workers handling such equipment.

It is preferable that additional conveyer means be disposed intermediate the inlet of the heating means at the place where assembled moulds are brought to be filled with molten metal and the outlet of the heating device at the place where the metal cast in the mould passes through the stage of solidification. It is also desirable that said conveyer means be made in the form of a reciprocating through conveyer having transfer devices arranged at both ends thereof.

Such structural arrangement of the additional conveyer means allows for the storage of the assembled moulds without transferring the latter to the conveyer of the pouring unit, which considerably enhances the production rate of the automatic line.

It is advisable that the transfer devices are made in the form of a table provided with a reversing drive for its vertical movement, and a reciprocatingly driven roller conveyer mounted on said table is intended for conveying the assembled moulds in the horizontal direction.

Such structural arrangement of the transfer devices makes them simple in construction and operation.

BRIEF DESCRIPTION OF THE DRAWINGS

The preferred embodiment of the invention will now be described by way of example, with reference to the accompanying drawings, in which.

DESCRIPTION OF THE PREFERRED EMBODIMENT

Figure 1:
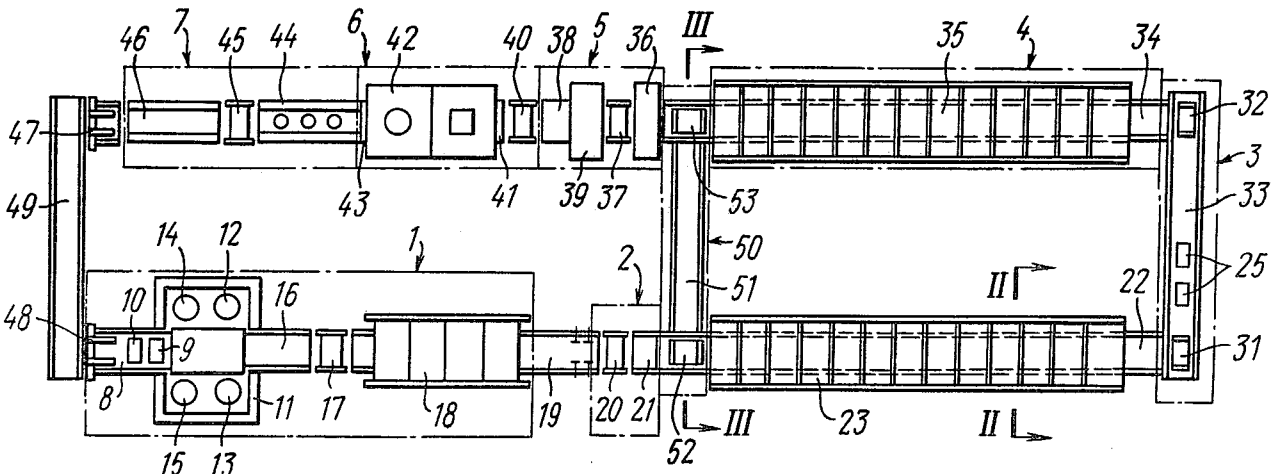
FIG. 1 is a general schematic view of an automatic line for casting into coated metal moulds according to the invention.

Referring now to the above drawings and to FIG. 1 in particular, there is shown an automatic line for casting into coated metal moulds, which basically comprises separate process units, each of which is adapted to perform a complete cycle of a definite operation of the production process.

These individual units are interconnected with one another by conveyer means.

This being the automatic line construction, the conveyer means, as has been mentioned above, can be used as storages for separate parts of a metal mould or for assembled moulds. In the herein described preferred embodiment of the invention, the conveyer means are made in the form of conventional power-driven friction roller tables, which renders them suitable to function as storages. It also makes for easier control of the automatic line operation since the roller tables lend themselves readily for continuous operation without requiring periodic on-and-off control commands. The aforementioned specific embodiment of the conveyer means in the form of power-driven friction roller conveyers does not preclude the application of other conventional conveyer means such as car-type conveyers, gravity roller conveyers, etc.

The automatic line of the invention comprises, successively arranged in the direction of the production process, a unit 1 for applying a coating to the working surface of the metal mould parts and its setting thereon, a unit 2 for assembling metal moulds from the coated parts thereof, a unit 3 for pouring molten metal into the assembled mould, a unit 4 for solidifying the casting inside the mould, a unit 5 for disassembling the mould and removing the casting therefrom, a unit 6 for cleaning the mould parts from the used coating, and a unit 7 for stabilizing the temperature of the cleaned mould parts prior to a re-coating cycle.

In accordance with the preferred embodiment of the invention the unit 1 for applying a coating to the working surfaces of the metal mould parts and its setting thereon comprises a feed conveyer 8 adapted to deliver the metal mould upper parts 9 and lower parts 10 to a shuttle sand blowing machine 11 having four heated pattern plates mounted on lifting tables of the known construction, i.e. two pattern plates are intended for the metal mould upper parts, and the other two for the mould lower parts (not shown). The blowing machine is provided with sand blowing heads 12,13,14 and 15 for applying a coating, prepared, for example, from heat-setting sand-resin mixtures, to the working surfaces of the metal mould parts. The blowing heads 12,13,14 and 15 are fitted with adjustable nozzles and constructed to the known design (cf. P.L. Snezhnoi and others, "Technologicheskie Osnovy y kompleksnaya mechanizatsija protsessa polucheniya otlivok iz chernych splavov v oblitsovanych kokiliach", Process Fundamentals and Comprehensive Mechanization of Coated Metal Mould Casting, "Liteinoe Proizvodstvo" magazine, 1973, No. 11). The coating is applied simultaneously to the mould upper part 9 and to lower part 10 by the diagonally disposed sand blowing heads 13 and 14. The delivery of the mould uncoated parts 9 and 10 from the conveyer 8 for coating to be effected by the sandblowing heads 12 and 15 or by those shown at 13 and 14, as well as the unloading of the mould coated parts placed on a discharge conveyer 16, is carried out by means of two-station suspended carriages (not shown).

In the preferred embodiment of the invention, the coating unit 1 also comprises the discharge 16 intended for unloading the mould coated parts from the sand-blowing machine 11, and a manipulator 17 adapted to turn over the mould coated parts 9 and 10 with the working face up.

The manipulator 17 is a known design widely used in automatic moulding and pouring units for tilting moulds and their parts (cf. Foundry Trade Journal, 1972, No 2900).

If necessary, the unit 1 for applying a coating may incorporate a means 18 adapted to ensure (repeated) setting of the coating.

According to the preferred embodiment of the invention, the means 18 is basically a through-type furnace intended for additional heating of the coating, and it is furnished with a conveyer 19. Said means 18 may comprise any other suitable constructional arrangement depending upon the process requirements for effecting the setting of a coating applied to the working surfaces of the metal mould parts.

The unit 1 for applying a coating may have any other constructional modifications specified by the production process. For example, it can be made in the form of a multi-station turn-table fitted with one blowing head and provided with manipulators for placing the metal mould uncoated parts on this table and removing the coated parts therefrom.

The mould coating unit 1 is connected with the mould assembly unit 2 by means of the conveyer 19. In the preferred embodiment of the invention, the assembly unit 2 comprises a manipulator 20 for turning over the upper part of the mould 9 with the working face down, said manipulator being similar in construction to that of the manipulator 17, and a manipulator 21 for effecting the mould assembly from the parts thereof. The aforementioned manipulators are universally known and widely used in foundry practice.

The assembly unit 2 may be constructed alternatively in the form of a turnover device mounted above the conveyer and adapted for turning over the metal mould upper part with the joint face down, incorporating as well a device for lifting the metal mould.

The assembly unit 2 is connected with the pouring unit 3 by means of a conveyor 22.

Figure 2:
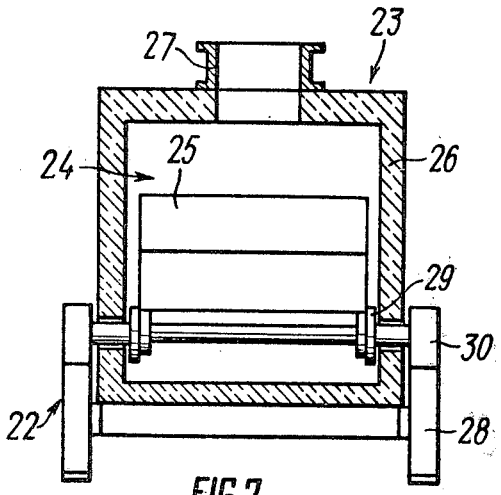
FIG. 2 is a cross-sectional view taken along the line II—II of FIG. 1, showing a conveyer means in the process of feeding assembled moulds to a pouring unit and to a unit for the solidification of the metal being cast in a mould.

Mounted on the conveyer 22 is a heating means 23 intended for maintaining the temperature of the assembled moulds prior to the pouring of molten metal into said moulds. The heating means 23 is basically a furnace 24 (FIG. 2) with the conveyer 22 passing therethrough and adapted to transfer assembled moulds 25 from the assembly unit 2 to the pouring unit 3.

In the preferred embodiment of the invention, the furnace shell 26 encloses a conveyor and is formed with branch pipes 27 for connection to a ventilating system. The furnace shell 26 is mounted on supports 28 of the conveyer 22 on whose rollers 29 the assembled mould 25 are transferred within the furnace 24. Maintained within the furnace 24 by conventional heating devices (not shown) is the temperature which corresponds to that of the metal mould parts after a coating was applied and hardened thereon. To avoid overheating of ball bearings, the supports 30 of the rollers 29 are arranged on the outside of the furnace 24.

The length of the heating means 23 is selected so as to enable not less than half of the assembled moulds simultaneously used in the process to be arranged therein. The length of the conveyor 22 corresponds to that of the heating means 23, i.e. it is slightly in excess of the length of the heating means 23, thereby enabling additional mould transferring devices to be arranged on the conveyer 22.

The pouring unit 3 (FIG. 1) comprises transfer devices 31 and 32, and a conveyer 33 carrying the assembled moulds 25, with molten metal being poured thereinto. The pouring process is effected by any conventional means.

The delivery of the assembled moulds to the conveyor 33 and subsequent delivery of the moulds filled with molten metal from the conveyer 33 is carried out by transfer devices 31 and 32, respectively. In the preferred embodiment of the invention, the transfer devices are made in the form of conventional lifting tables with power-driven roller conveyors. However, other conventional transfer means may be used, for instance, lifters and pushers.

The transfer device 32 interconnects the pouring unit 3 and the casting solidification unit 4. In the preferred embodiment, the unit 4 incorporates a reversible conveyer 34 and a heating means 35, which are similar in construction to the conveyer 22 and the heating means 23, respectively.

The time period of transferring the assembled mould filled with molten metal along the conveyer 34 corresponds to the casting solidification period. It is advisable that the travelling speed of the conveyer 34 be adjustable as the solidification time of the castings being produced on the automatic union of the invention may thus be varied, if desired.

The length of the heating means 35 and that of the conveyer 34 is selected on the same grounds as in the case of the heating means 23 and the conveyer 22. Therefore, the overall length of the heating means 23 and 35 provides, in the preferred embodiment of the invention, for the arrangement of all of the assembled moulds therein. This makes it possible to maintain their requisite temperatures during idling periods, and eliminate the possibility of lower efficiency and impaired quality of the castings in the subsequent operation of the automatic unit.

The heating means 35 is operated intermittently. Under normal operating conditions of the automatic line it serves as a ventilated cover for the poured-in moulds, used to bring under control noxious fumes and liberated heat, thereby substantially improving health conditions of the work areas. If the automatic unit comes to a halt, the heating system is operated and the heating means 35 functions to maintain the temperature of the assembled moulds which have not yet been filled with molten metal, said mould being transferred therein from the assembly unit 2 by means of the transfer devices 31 and 32, and the conveyers 33 and 34.

The conveyer 34 is connected with the unit 5 for the mould disassembly and removal of the castings. In the preferred embodiment of the invention, the disassembly unit 5 comprises the following successively arranged means: a manipulator 36 for disassembly and cleaning of the supercharging holes in the upper part of the metal mould, a manipulator 37 for turning over the lower part of the metal mould, its working face down, similar in construction to the manipulator 17, a conveyer 38 and a manipulator 39 for removing a casting form the lower part of the mould and cleaning its supercharging holes.

The manipulators 36 and 39 are of conventional design extensively used in automatic casting lines. In the preferred embodiment, said manipulators are basically lifters with carrying hooks for lower and upper parts of a metal mould, and a set of stationary rods for cleaning supercharging holes in the mould parts.

The diassembly unit 5 may have other embodiments.

The conveyer 38 interconnects the disassembly unit 5 with the unit 6 for cleaning the mould parts from the used coating. In the preferred embodiment of the invention, the unit 6 comprises a manipulator 40 for turning over the mould parts, their working surfaces up, which is similar in construction to the manipulator 17, a conveyer 41 and a device 42 for cleaning the mould parts from the used coating.

The device 42 incorporates conventional mechanisms which are extensively used in automatic lines for casting into coated metal moulds and are intended for breaking down the coating along the joint face and its subsequent removal by blowing it out with compressed air. In the preferred embodiment, the coating breakdown mechanisms are placed in a dust-and-air proof enclosure member with a view to improving working conditions.

The conveyor 41 interconnects the cleaning unit 6 with the unit 7 for stabilizing the temperature of the metal mould cleaned parts prior to a re-coating cycle. In the preferred embodiment, the unit 7 incorporates a conveyer 43 carrying a chamber 44 for cooling the mould parts to a temperature required for the coating operation; a manipulator 45 for turning over the mould parts, with their working faces down, which is similar in construction to the manipulator 17; and a conveyer 46 for transferring the mould parts. The chamber 44 is of conventional construction widely used for cooling casting moulds. It is fitted with nozzles for supplying a coolant such as an water-air mixture, to be applied to the working surfaces of the mould parts transferred by the conveyor 43. The chamber 44 may be replaced by a means for heating the mould parts where the mould capacity is small enough, and therefore unable to sufficiently heat the mould parts with the molten metal poured into the mould. A combined device for heating or cooling the mould parts can likewise be used depending upon the requirements of the production process.

The conveyer 46 interconnects the unit 7 and the feed conveyer 8 of the unit 1 by means of transfer devices 47 and 48, and an intermediate conveyer 49. The transfer devices 47 and 48 are of conventional design and, in the preferred embodiment of the invention, they can be made in the form of lifting tables with power-driven table rollers, or they may take the form of any other known constructional embodiment.

The section of the conveyer 22 (FIGS. 1 and 3) adapted for the delivery of the assembled moulds to a pouring station is connected with the section of the conveyer 34, transferring the poured-in moulds from the pouring unit 3 to the disassembly unit 5, through an additional conveyer means 50 intended for transferring the assembled moulds from one section to another. In the preferred embodiment of the invention, the additional conveyer means 50 comprises a reversible conveyer 51, with transfer devices 52 and 53 being arranged on both sides thereof. The transfer device 52 is mounted on the conveyer 22 intermediate the assembly unit 2 and the inlet of the heating means 23, and the transfer device 53 is mounted on the conveyer 34 intermediate the outlet of the heating means 35 and the disassembly unit 5.

With the additional conveyer means 50, it is possible to use the heating means 35 of the casting solidification unit 4 as a storage for the assembled coated moulds, since at the beginning of the operation said mould can be transferred on to the conveyer 22 to be thereby delivered to the pouring unit 3. The possibility of using the heating means 35 as a storage for the assembled coated moulds enables reducing the length of the storage two times, and, consequently, the overall length of an automatic casting line. In addition, the provision of the reversible conveyer 51 makes it possible to substantially increase the production rate of the automatic line, since the reversible principle of said conveyer enables the charging of the assembled moulds (both coated and uncoated) into the heating means 35 bypassing the pouring unit 3.

Figure 4:
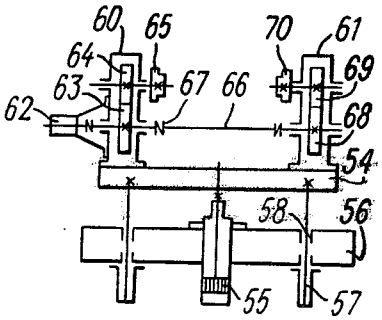
FIG. 4 is a cross-sectional view taken along the line IV—IV of the transfer device shown in FIG. 3.
Figure 3:
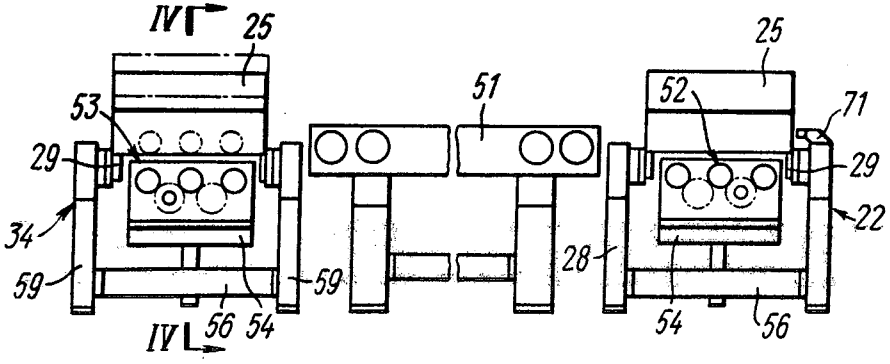
FIG. 3 is a side elevational view (from the plane of section III—III of FIG. 1) of an intermediate conveyer means with transfer devices.

In the preferred embodiment of the invention, the devices 52 and 53 (FIGS. 3 and 4) comprises a table 54 provided with an actuator enabling its reversible vertical movement. The actuator is basically a power cylinder 55 (FIG. 4) mounted on a frame 56 (FIGS. 3 and 4). The table 54 is moved along guides 57 (FIG. 4) whose supports 58 are mounted on the frame 56. The frames 56 are mounted on the supports of the conveyers 22 and 34. To be more exact, the frame 56 of the device 52 rests on the supports 28 (FIG. 3) of the conveyer 22, and the frame 56 of the device 53 rests on supports 59 of the conveyer 34.

Mounted on the table 54 are reversible power-driven roller conveyers 60 and 61 (FIG. 4). The roller conveyer 60 carries a reversible actuator 62, for instance, a hydraulic engine or electric motor, which imparts rotary motion through a train of gear wheels 63 and 64 to rollers 65, and through a connecting shaft 66, clutches 67 (on both ends of the shaft) and gear wheels 68 and 69 so that rotary motion is imparted to rollers 70 of the roller conveyer 61. Additionally, mounted on the conveyer 22 is a thrust member or stop 71 of the device 52, as best shown in FIG. 3.

While the invention has been described in terms of the preferred embodiment, numerous variations may be made in the automatic casting unit illustrated in the drawings and as described without departing from the invention as set forth in the appended claims. The herein disclosed examplary embodiment is preferable in view of the fact that it ensures constructional simplicity of the conveyer means and individual devices of the automatic line, with the mould parts and assembled moulds travelling along linear paths.

The automatic casting line of the invention is advantageous over the prior-art units because it allows the arrangement of heating means on the conveyer intermediate the assembly line and the pouring unit on the one side, and intermediate the pouring unit and the disassembly unit on the other; in addition to having the provision of additional conveyer means.

The automatic casting line of the invention operates in the following manner.

While putting the automatic line into operation, the whole set of the assembled moulds 25 is placed in the heating means 23 and 25 (FIG. 1). The assembled parts, heated to a temperature slightly in excess of that required for the coating operation, this being done to compensate for unavoidable heat losses due to shipment, are transferred by the conveyer 34 from the heating device 35 of the solidification unit 4 to the disassembly unit 5. The moulds in the heating device 23 are transferred by the conveyor 22 of the transfer device 31, as well as by the conveyer 33 and the transfer device 32, to be set on the now vacant places on the conveyer 34. The transfer device 53 of the additional conveyer means 50 remains in its initial (lower) position without hindering the movement of the assembled moulds along the conveyer 34.

The manipulator 36 of the disassembly unit 5 is operated to remove the upper part of the metal mould from the lower one which, remains on the conveyer 34, and is fed to the manipulator 37 to be thereby turned over with the working face down, and then to the manipulator 39 which functions to lift said lower part of the mould from the conveyer 38. After the mould lower part is removed, its upper part is lowered down by the manipulator 36 on to the conveyer 38 and successively passes without being tilted through the manipulators 37 and the manipulator 39 which now functions to support the mould upper part in the suspended position. After the mould upper part has passed through the manipulator 39, the manipulator 39 functions to lower down the mould lower part on to the conveyer 38. Thus, the remainder of the way travelled by the mould parts is in strict order, namely: the lower part of the mould follows the upper one.

Separate parts of the mould are further transferred by the conveyer 38 of the cleaning unit 6 to the manipulator 40, wherein they are turned over with the working faces up and are thereafter delivered by the conveyer 41 of the cleaning unit 6 and by the conveyer 43 of the temperature stabilizing unit 7 to the manipulator 45, wherein said parts are turned over with the working face down. While the separate parts of the moulds pass through the device 42 of the cleaning unit 6, the cleaning unit 6 is not actuated to thereby allow passage of the mould parts therethrough without any obstruction or hindrance. During further movement of the mould parts through the cooling chamber 44 of the unit 7, the system of supplying coolant to the working faces of said parts is shut down.

Once out of the manipulator 45, the mould parts are transferred by the conveyer 46 to the transfer device 47 which is operated to lift said parts one after another from the conveyer 46 of the unit 7 and to thereafter place them on to the intermediate conveyer 49. The mould parts are removed from the conveyer 49 by the transfer device 48 and are then placed on the conveyer 8 of the coating unit 1. After the mould parts, preheated to a prescribed temperature, have been placed on the conveyer 8, the automatic line starts operating under steady working conditions.

The automatic line of the invention operates under steady working conditions in the following manner.

The mould upper part 9 and the mould lower part 10, their working faces down, are transferred in pairs by the conveyer 8 into the sand-blowing machine 11. By means of two-station power-driven suspended carriages (not shown), the mould parts 9 and 10 are respectively positioned opposite the sand-blowing heads 12 and 15, whereupon patterns, preheated to a working temperature and arranged at these stations, are lifted so as to be connected with the corresponding parts of the metal moulds, by pressing said parts up against the nozzles (not shown) of the sand-blowing heads 12 and 15. Thereafter, a facing sand is blown into the working space defined by the pattern and the metal mould working surface. The pattern remains in contact with the corresponding part of the metal mould for a time period allowing for either a complete setting of the applied coating or to a point in time where it can be further transferred. In the course of the aforedescribed operations, a next pair of the mould parts 9 and 10 is delivered to the second station of the carriage of the sand-blowing machine 11.

After the coating applied to the mould parts 9 and 10 is hardened, the patterns arranged below the sand-blowing heads 12 and 15 are lowered down, and the mould coated parts are transferred by the carriages to the intermediate station of the sand-blowing machine 11. The uncoated metal mould parts 9 and 10, placed on the carriage second station, are respectively transferred to the sand-blowing heads 13 and 14, to undergo a coating operation similar to that described hereinabove. The coated metal mould parts 9 and 10 are delivered to the conveyer 16 while another pair of the uncoated metal mould parts 9 and 10 is fed to be coated.

The metal mould coated parts are transferred by the conveyer 16 to the manipulator 17 wherein said parts are turned over, the working face up, to be thereafter successively delivered into the heater 18 and then to the conveyer 19.

The heating means 18 is intended to provide additional setting of the coating which may not be completely set in the machine 11 due to the increased production rate of the process.

The quality of the coating is checked on the conveyor 19 and, if necessary, cores are set whereupon the metal mould coated parts are delivered to the manipulator 20 of the assembly unit 2.

The manipulator 20 is operated to turn over the upper part of the mould with its working face down, said part being then transferred to the manipulator 21 which functions to lift it above the conveyer 22. The lower part of the metal mould passes unturned through the manipulator 20 and is then transferred by the conveyer 22 to the manipulator 21 wherein the mould upper part is placed on its lower part. In such a manner a mould is assembled from the coated parts thereof.

The assembled mould is transferred by the conveyer 22 to and heating means 23, the thence to the transfer device 31 of the pouring unit 3.

In the heating means 23 the temperature of the assembled moulds is always maintained within a prescribed range, both during their continuous movement or stoppage and storage periods, or during idling periods when the supply of molten metal is terminated.

The transfer device 52 of the additional conveyer means 50 is in its initial (lower) position and therefore does not hinder the movement of the assembled moulds along the conveyer 22.

The device 31 functions to transfer the assembled moulds 25 on to the conveyer 33 whereupon molten metal is poured into the assembled moulds by any conventional means. The pouring operation is effected either in the course of the conveyer travelling or during its stoppage periods, depending upon the process requirements. The poured-in moulds are transferred by means of the device 33 on to the conveyer 34 of the casting solidifying unit 4.

The poured-in moulds travel along the conveyer 34 through the heating means 35 for a time period required for a casting to solidify inside the mould. It is possible to vary the casting solidification time by adjusting the travelling speed of the conveyer 34. Under normal operating conditions of the automatic line, heating devices of the heating means 35 do not function and the latter serves in this case as a heat-insulating and ventilating enclosure for the poured-in moulds, thereby providing for improved health conditions of foundry shops.

The poured-in moulds 25 containing the solidified castings are transferred by the conveyer 34 to the unit 5 for disassembling the mould and removing the casting, the device 53 being in its initial (lower) position allowing free movement of the poured-in moulds along the conveyer 34.

In the event of a long idling period of the pouring unit 3, the assembled moulds are accumulated in the heating means 23 until it is packed full. If the pouring unit 3 still remains inoperative, the assembled moulds 25 are conveyed from the heating means 23 by the conveyer 22, transfer device 31, conveyer 33, transfer device 32 and conveyer 34 to the heating means 35 without being filled with molten metal. The heating means 35 is energized, and with the temperature maintained therein being equal to that in the heating means 23, which means also serves in this case as a storage for the assembled moulds. When the pouring unit 3 becomes operative, the assembled moulds are transferred from the heating means 23 for pouring effected in a manner similar to that described above. The assembled moulds in the heating means 35, which have not yet been filled with molten metal are transferred by means of the additional conveyer means 50 to the conveyer 22 and further on through the heating means 23 to the pouring unit 3. After the heating means 35 is free from the assembled unfilled moulds, the heating devices of the means 35 are deenergized.

The conveyer means 50 operates as follows (FIGS. 3 and 4).

The assembled moulds are transferred by means of the conveyer 34 to the transfer device 53. The table 54 of the device 53 is lifted with the aid of the cylinder 55. The assembled mould 25 is lifted off the rollers 29 of the conveyer 34 and placed on the rollers 65 and 70 of the roller conveyer 60 and 61. By energizing the reversible actuator 62, the rollers 65 and 70 are set in rotary motion through a train of gear wheels 63, 64 and 68, 69, and through the connecting shaft 66 and clutches 67, thereby transferring the mould 25 on to the conveyer 51. The actuator 62 of the transfer device 53 is deenergized, and its table 54 is lowered down by means of the cylinder 55 to receive a new mould 25 thereupon. The assembled mould 25 is carried on the conveyer 51 until it is thrust up against the stop 71 of the transfer device 52, with the table 54 thereof being lifted at this time. The mould 25 slides over onto the rollers 65 and 70 of the transfer device 52. The devices 52 and 53 are similar in their operation.

A shut-off member (not shown) is operated to stop the mould transfer from the conveyer 51 to the device 52, the latter being lowered down together with the mould 25 which is then transferred by the conveyer 22 to the heating means 23, and further on to the pouring unit 3. The table 54 of the device 52 is lifted to receive the forthcoming mould 25 and the shutoff member is opened. The poured-in moulds delivered to the disassembly unit 5 are first fed to the manipulator 36, and with the aid of the clamping means of the manipulator 36, the lower part of the metal mould is lifted off the lower one. The supercharging holes in the upper part of the mould are concurrently cleaned by means of stationary rods and a casting is forced out to the mould lower part to be fed to the manipulator 37 wherein it is turned over, with the working face down, with the casting dropping out of the mold. In the manipulator 39 the lower part of the mould is lifted as the supercharging holes thereof are concurrently cleaned. Subsequent operations are similar to those described above during the initial stage of operation.

The mould parts, with the lower part following the upper one, are then transferred by the conveyer 38 to the manipulator 40 of the unit 6 for cleaning the mould parts of the used coating. In the manipulator 40 the mould parts are turned over, their working faces up, and then are transferred by the conveyer 41 to the device 42 wherein the coating is destroyed along the joint face by means of a roller fracture member. The broken fractured coating is then ejected with a blast of compressed air. Due to the provision of the dust-proof-and-noise-proof shell, health conditions in the cleaning zone are normalized.

Upon completion of the cleaning operation, the mould parts are transferred by the conveyer 43 to the cooling chamber 44 of the unit 7 for stabilizing the temperature of the cleaned mould parts prior to a recoating cycle. Within the chamber 44, the mould parts are cooled by means of spraying nozzles to a temperature required for subsequent coating.

The sequence of operations of transferring the cleaned and preheated metal mould parts to the conveyer 8 of the unit 1 for applying a coating to said parts is similar to that described above with reference to the initial stage of operation of the automatic line.

When the automatic line is shut down for a long period of time, for example, on weekends, the heaters 23 and 35 are energized to maintain the required temperature of the moulds. The assembled moulds, coated or uncoated, in the latter case the metal mould parts pass through the sand-slinger 11 without being fed to the stations of the sand-slinging heads 12 and 15, and are transferred in a manner described above to the heating means 23 and 35. Insofar as the heating means 23 and 35 are capable of housing all the moulds found on the line, it is possible to maintain all of said moulds at a temperature which is required for the process operations.

Due to the fact that the additional conveyer means 50 and the conveyer 34 are made reversible, it is possible to carry out charging of the heating means 35 with the assembled moulds bypassing the pouring unit 3. This being the case, the assembled moulds are transferred by the conveyer 22 to the device 52, and then by means of the latter and the conveyer 51, as well as by means of the device 53, said parts are transferred to the conveyer 34 which is designed for reversive operation. The devices 52 and 53 function in a manner similar to that described above, the former being lowered down when in its initial position, and the latter being lifted up.

Provided the assembled and coated metal mould parts are placed for storage in the heating means 23 and 35, the first operation to start is pouring. This being the case, the operating process of the automatic line runs in a manner similar to that described above as is the case when the assembled moulds are accumulated in the heating means 23 and 35, with the pouring unit 3 remaining inoperative.

If the heating means 23 and 35 are used for storing uncoated assembled moulds, the automatic line operates in accordance with initial operating conditions described herein above.

Therefore, the automatic line of the invention ensures the production of high-quality castings strictly conforming to a specified configuration, structure and physical-and-mechanical properties of metal. The crucial feature of the invention is in ensuring the production of castings having the desired properties with the automatic line of the invention functioning under various operating conditions, for instance, in steel making where metal pouring operation is effected in a stepwise fashion.

The present invention also makes it possible to enhance production efficiency, improve working conditions, substantially reduce the overall length of the automatic line and, consequently, decrease the expenses involved in its manufacture, installation and maintenance.

What is claimed is:

1. An automatic line for casting into coated metal moulds assembled from separate parts thereof, comprising:

a unit for applying a coating to the working surface of said metal mould parts so as to be set thereon, said unit incorporating:

a feed conveyer adapted to deliver said metal mould parts for a coating to be applied to said working surface thereof, a sand-blowing machine intended for applying a coating to the working surfaces of said metal mould parts, said machine being arranged directly after said feed conveyer, a first turnover manipulator for turning over said metal mould coated parts, with the working face up, arranged after said sand-blowing machine in the direction of the coating process, a discharge conveyer connecting said sand-blowing machine with said first turnover manipulator for transferring said coated metal mould parts from said sand-blowing machine to said first turnover manipulator, a device adapted to provide for additional setting of the coating applied to the working faces of said metal mould parts, arranged directly after said first turnover manipulator and formed as a heating means provided with a first conveyer for transferring said coated metal mould parts from said first turnover manipulator to said heating means;

a unit for assembling a complete mould from said separate coated metal mould parts, arranged in the direction of the assembly operation directly after said coating unit and incorporating:

a second turnover manipulator for turning over the upper part of an assembled mould with its working face down, an assembly manipulator for assembling said coated metal mould parts into a complete mould, arranged directly after said second turnover manipulator for turning over the upper part of a coated mould, a second conveyer connecting said first conveyer incorporated in said device for additional setting of the coating with said second turnover manipulator incorporated in said assembly unit for transferring said coated metal mould parts from said additional coating setting device to said second turnover manipulator;

a unit for pouring molten metal into said assembled mould having an inlet and an outlet, arranged in the direction of the production process after said assembly unit and incorporating:

a third conveyer intended for transferring said assembled moulds in said pouring unit where molten metal is poured while said moulds are on said third conveyer, a transfer device arranged on each end of said third conveyer for placing said assembled moulds on said third conveyer and removing said moulds therefrom, a device, including a fourth conveyer connecting said assembly manipulator with said transfer device arranged at the inlet of said pouring unit and including further heating means for maintaining a requisite temperature of said assembled moulds awaiting to be filled with molten metal;

a unit for solidifying a casting inside the mould, arranged directly after said pouring unit and incorporating:

a fifth conveyer adapted to receive and transfer poured-in moulds from said transfer device arranged at the outlet of said pouring unit, additional heating means arranged on said fifth conveyer of the casting solidification unit and energized upon shutting down of the automatic line as a whole;

a unit for disassembling said mould and removing the casting therefrom, arranged directly after said casting solidification unit and incorporating:

a disassembly manipulator for disassembling said mould and cleaning supercharging holes fitted in said metal mould upper part, connected with said solidification unit conveyer, a third turnover manipulator for turning over said metal mould lower part with the casting contained therein, with the working face down, arranged directly after said disassembly manipulator, a manipulator for removing said casting from said lower part of the mould and cleaning said supercharging holes fitted in said mould, arranged directly after said third turnover manipulator for turning said metal mould lower part, a sixth conveyer connecting said manipulator for removing the casting from said metal mould lower part with third turnover manipulator;

a cleaning unit for cleaning said metal mould parts of any used coating, arranged directly after said disassembly unit and incorporating:

a fourth turnover manipulator for turning over said metal mould parts with their working faces up, connected with said disassembly unit conveyer, a cleaning device for removing the remnants of the used coating from said metal mould parts, arranged directly after said fourth turnover manipulator incorporated in said cleaning unit, a seventh conveyer connecting said fourth turnover manipulator incorporated in said cleaning unit with said cleaning device;

a unit for stabilizing the temperature of said cleaned mould parts, arranged directly after said cleaning unit and incorporating:

a device for stabilizing the temperature of said cleaned metal mould parts, formed as a chamber for cooling said metal mould parts, a fifth turnover manipulator for turning over said metal mould parts with the working faces down, arranged directly after said cooling chamber, an eighth conveyer carrying said cooling chamber and connecting said turnover manipulators incorporated in the cleaning unit and temperature stabilizing unit, a second discharge conveyer manipulator for removing said metal mould parts from said turnover manipulator incorporated in the temperature stabilizing unit, an intermediate conveyer connecting said temperature stabilizing unit with said coating unit for transferring said metal mould parts from the temperature stabilizing unit to the coating unit, a transfer device arranged intermediate said temperature stabilizing unit and said intermediate conveyer for transferring the metal mould parts from said second discharge conveyer incorporated in the temperature stabilizing unit to said intermediate conveyer, a transfer device arranged between said intermediate conveyer and said coating unit, for transferring said metal mould parts from the intermediate conveyer to said feed conveyer incorporated in the coating unit, an additional conveyer means connecting a section of said device connecting said assembly manipulator with said transfer device with a section of said fifth conveyer incorporated in the casting solidification unit, for transferring said assembled moulds from one said section to another.

2. An automatic line as claimed in claim 1, wherein every heating means comprises a furnace with a conveyer means of the corresponding section passing therein.

3. An automatic line as claimed in claim 2, wherein the length of each said furnace corresponds to that of the conveyer means passing therein.

4. An automatic line as claimed in claim 1, wherein said additional conveyer means interconnects the inlet of said heating means at the unit where the assembled moulds are delivered for pouring and the outlet of said heating means at the unit where the casting is allowed to solidify inside the mould.

5. An automatic line as claimed in claim 4, wherein said additional conveyer means comprises a conveyer with a transfer device arranged at both ends.

6. An automatic line as claimed in claim 5, wherein said conveyer is made reversible.

7. An automatic line as claimed in claim 5, wherein said transfer device incorporates:

a table, a reversible drive connected with said table and enabling said table to move in a vertical direction, and drive rollers mounted on said table and enabling said assembled moulds to be transferred in the horizontal direction.

* * * * *